US006240945B1

(12) United States Patent
Srinath et al.

(10) Patent No.: US 6,240,945 B1
(45) Date of Patent: Jun. 5, 2001

(54) METHOD AND APPARATUS FOR YAWING THE SPRAYS ISSUED FROM FLUIDIC OSCILLATORS

(75) Inventors: Dharapuram N. Srinath; Surya Raghu, both of Ellicott City, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 0 days.

(21) Appl. No.: 09/594,770

(22) Filed: Jun. 16, 2000

Related U.S. Application Data

(63) Continuation-in-part of application No. 09/417,899, filed on Oct. 14, 1999.

(60) Provisional application No. 60/139,485, filed on Jun. 17, 1999.

(51) Int. Cl.[7] ..... F15C 1/12

(52) U.S. Cl. ..... 137/14; 137/826; 137/833; 239/589.1

(58) Field of Search ..... 239/589.1; 137/833, 137/826, 14

(56) References Cited

U.S. PATENT DOCUMENTS

| | | | | |
|---|---|---|---|---|
| Re. 27,938 | * | 3/1974 | Bauer | 239/589.1 |
| 4,463,904 | * | 8/1984 | Bray, Jr. | 239/589.1 |
| 4,508,267 | * | 4/1985 | Stouffer | 239/11 |
| 4,645,126 | * | 2/1987 | Bray, Jr. | 239/11 |
| 5,265,636 | * | 11/1993 | Reed | 137/14 |

* cited by examiner

*Primary Examiner*—A. Michael Chambers
(74) *Attorney, Agent, or Firm*—Jim Zegeer

(57) ABSTRACT

Fluidic oscillators with yawed liquid spray.

10 Claims, 4 Drawing Sheets

METHOD AND APPARATUS FOR YAWING THE SPRAYS ISSUED FROM FLUIDIC OSCILLATORS

REFERENCE TO RELATED APPLICATION

This application is the subject of provisional application Ser. No. 60/139,485 filed Jun. 17, 1999 entitled METHOD YAWING THE SPRAYS ISSUED FROM FLUIDIC OSCILLATORS and is a continuation-in-part of Raghu U.S. application Ser. No. 09/417,899 filed Oct. 14, 1999 entitled FEEDBACK-FREE FLUIDIC OSCILLATOR AND METHOD.

BACKGROUND AND BRIEF DESCRIPTION OF THE INVENTION

The present invention relates to fluidic oscillators for issuing liquid sprays in predetermined directions ambient.

Typically, when fluidic oscillators are used as windshield washers, headlamp washers, rear window washers, or in situations where the customer wants to retain the orientation of the nozzle in a symmetrical position while a cleaning function requirement might need the liquid spray to be yawed to the left or right of the centerline, physical rotation of the circuit would normally be required. This is done by either mounting the fluidic circuit in a rotating assembly or by physically rotating the design to achieve the angularity required.

According to the present invention, the nozzle is retained in a symmetrical position relative to the centerline of its housing, and the spray is yawed to the left or right of the centerline.

According to the invention, in a conventional feedback-type fluidic oscillator, the exit throat is shifted to either side of the centerline to reduce the space being yawed to the desired side. In multiple power nozzle oscillators of the type disclosed in the-identified Raghu application Ser. No. 09/417,899, the exit throat is shifted to the right or left while the power nozzle is shifted up and down relative to the symmetrical position. One preferred technique involves a combination of the above.

In addition, the physical rotation of the unit may be incorporated to enhance the degree of yaw, and the above novel techniques may be combined with shifting of two outlet walls up and down relative to each other.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
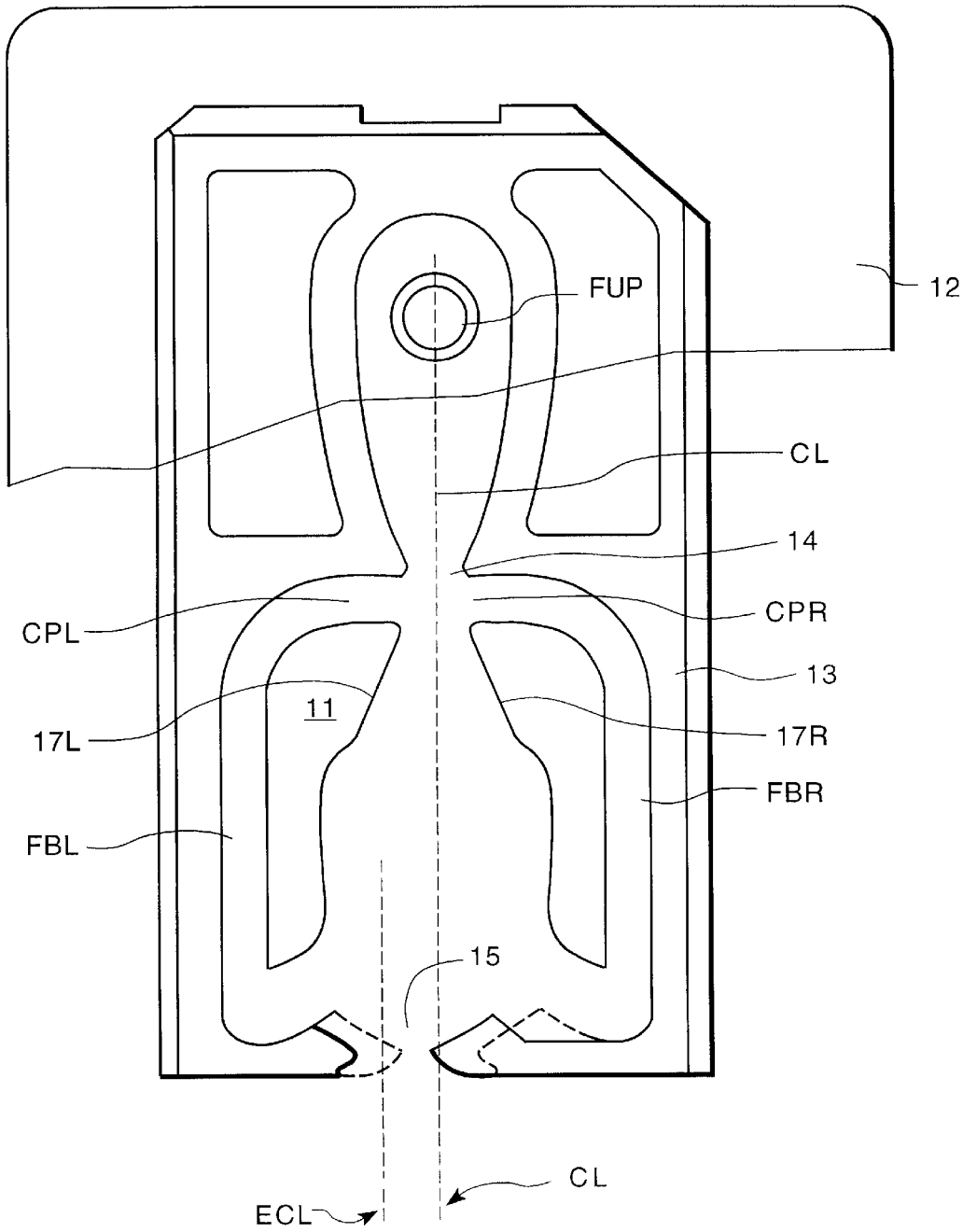
FIG. 1 is a circuit diagram of a conventional feedback-type oscillator incorporating the invention.

Referring now to FIG. 1, the silhouette 10 is of a conventional feedback-type fluidic oscillator 11 having a housing 12 into which is inserted the fluidic circuit chip 13. Fluidic circuit chip 13 has a power nozzle 14 which is coupled to a source of fluid under pressure FUP, such as a wash liquid, for projecting a fan spray upon the windshield of an automobile or upon the floor for a mop. The fluidic circuit oscillation is described in detail in Bray Pat. Nos. 4,463,904 and 4,645,126. In general, wash liquid is introduced into power nozzle 14 and a jet is projected through oscillation chamber 15 along the centerline CL towards an exit. The exit will be described later in detail in connection with the invention. The dotted exit line is the conventional or original position of the exit and it will be noted that it is aligned with the centerline CL of the power nozzle and the centerline for fluidic element. A jet of wash liquid is projected along the centerline CL and will create opposite vortices on each side of the centerline which become unbalanced and force the jet of fluid to one side or the other of the oscillation chamber. When the jet is forced to the left side, for example, it is attracted to the sidewall 17L and a portion of the flow is scooped off by the entranceway to the feedback passage FBL and carried back to the control port CPL which causes the jet to detach from the wall 17L and switch to the opposite sidewall where the process then repeats. The jet then attaches to the sidewall 17R and a portion thereof is scooped up by the scoop at the entranceway of feedback passage FBR and fed to control port CPR to cause the jet to detach from wall 17R and switch back to the opposite sidewall 17L. Note that as the jet proceeds through the switching operations, the fluid jet flows through the exit aperture 15 and sweeps back and forth, first exiting to the right and then to the left and sweeping back and forth therebetween. In this type of fluidic oscillator, there is a slight dwell due to the time it takes to cause a detachment of the jet from walls 17L and 17R. For an oscillator circuit which produces a more uniform droplet spray and without attachment walls, see Stouffer Pat. No. 4,508,267.

The Present Invention

According to the present invention, the outlet aperture 15 is shifted to one side or the other of the centerline CL. As illustrated in FIG. 1, the outlet or exit aperture has a centerline ECL which has been shifted to the left of centerline CL. This shifting of the centerline of the exit aperture to the left or right of the centerline of the oscillation chamber (and power nozzle) causes or induces the spray to yaw to the left side (or the right side if desired). Thus, the housing 12 and all other aspects of the fluidic element remains the same and may be incorporated in the conventional windshield washer nozzle assembly without changing the housing or any nozzle aiming angle or orientation.

Figure 2:
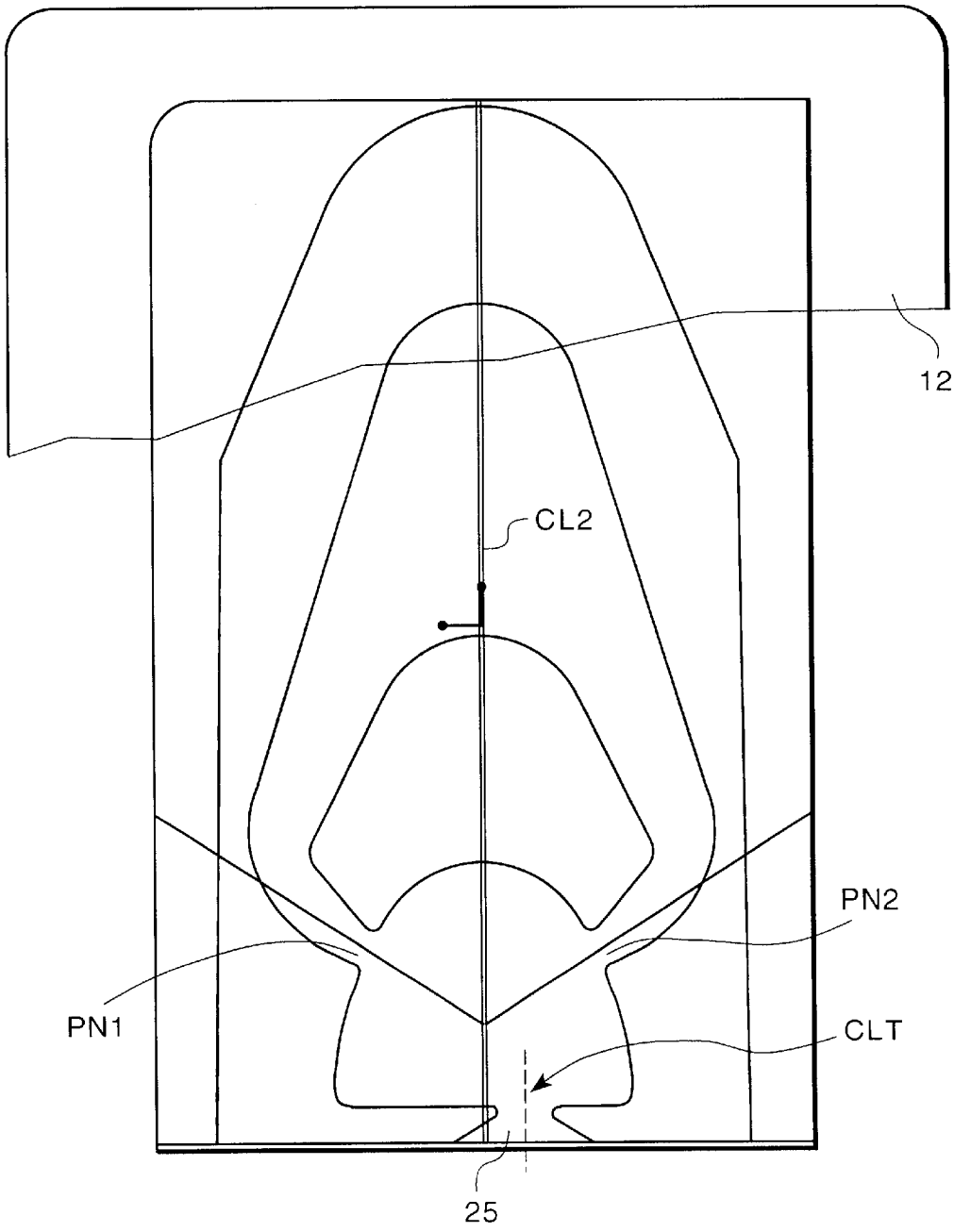
FIG. 2 is a circuit diagram of the invention as it is applied to a feedback-free fluidic oscillator os the type disclosed in the above-identified Raghu application Ser. No. 09/417,899.

FIG. 2 discloses an embodiment of the invention which utilizes an oscillator of the type disclosed in Raghu application Ser. No. 09/417,899 and particular reference is made to FIG. 10 thereof. In this type of fluidic oscillator, operation is based on the internal instability of two jets of liquid in a cavity. The two power nozzles PN1 and PN2 are properly sized and oriented, in this embodiment, to intersect along the centerline CL2 such that the resulting flow pattern develops a system of vortices which are inherently unstable and causes the two jets issuing from the power nozzles PN1 and PN2 to cyclically change their respective directions. This provides a sweeping jet at the exit 25. Note that the centerline CLT of the exit throat is shifted relative to the centerline CL2 of the fluidic circuitry. The exit outlet 25 can be designed to produce an oscillating sheet or area coverage of the fan-type spray. Power nozzles need not be symmetrically oriented relative to the central axis of an oscillation chamber. Moreover, as is illustrated in the preferred embodiment of this invention, the exit outlet 25 and outlet throat are adapted to issue a yawed sweeping jet. Note that the centerline of the exit throat is shifted relative to the centerline CL2 of the fluidic circuitry (right yaw).

Note also that the two power nozzles PN1 and PN2 are fed from a common manifold CM which is coupled to a source of liquid under pressure.

Figure 3:
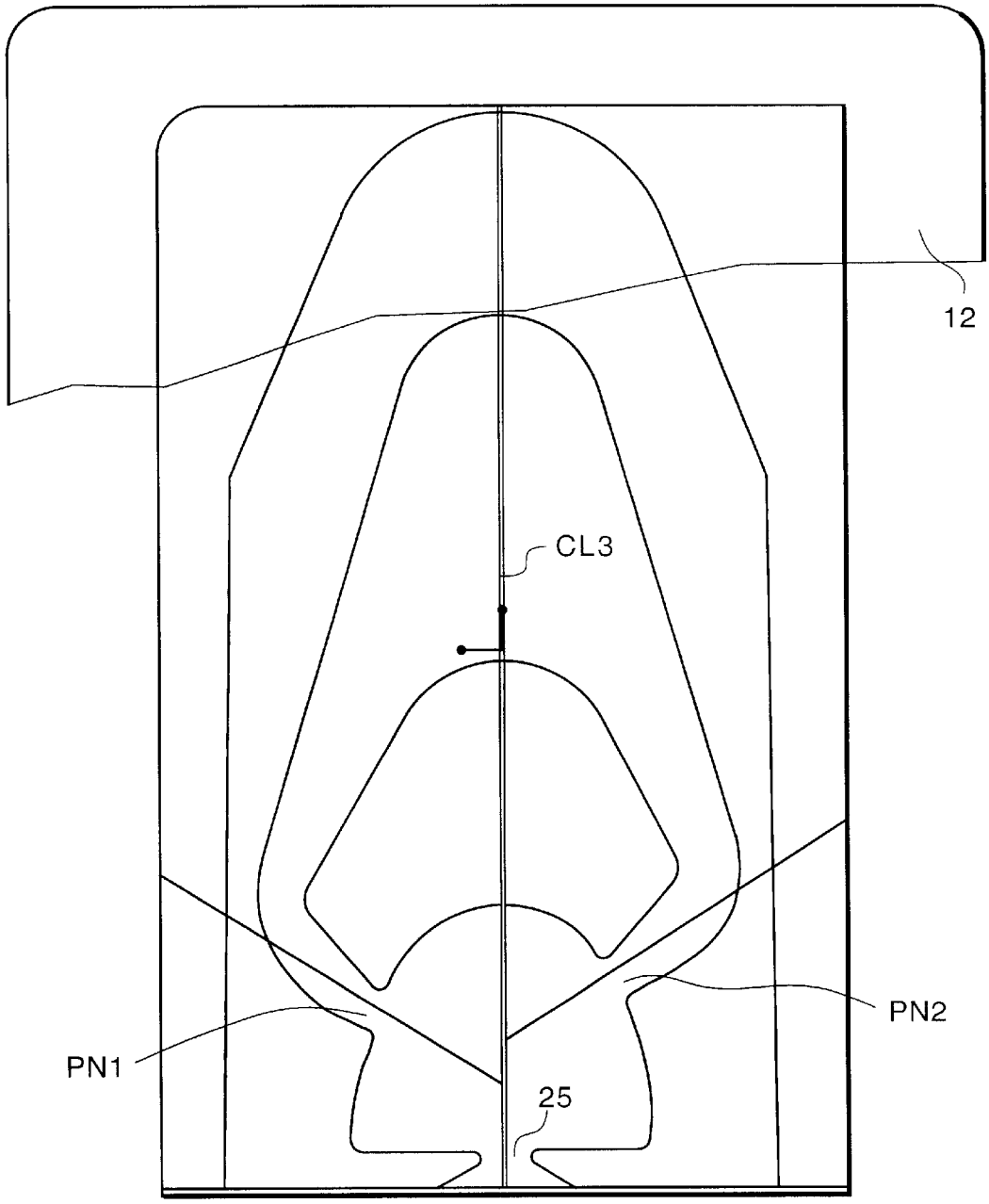
FIG. 3 illustrates a further embodiment of the invention.

Referring now to FIG. 3, instead of shifting the centerline of the exit throat 25 relative to the centerline of the fluidic circuit, the centerline of the power nozzle orifices PN1 AND PN2 are arranged so that they do not intersect at the centerline of the fluidic circuit. Thus, power nozzle PN1 intersects the centerline CL3 at a position slightly below where the centerline of power nozzle PN2 intersects the centerline CL3. In this embodiment the yaw is to the right.

Figure 4A:
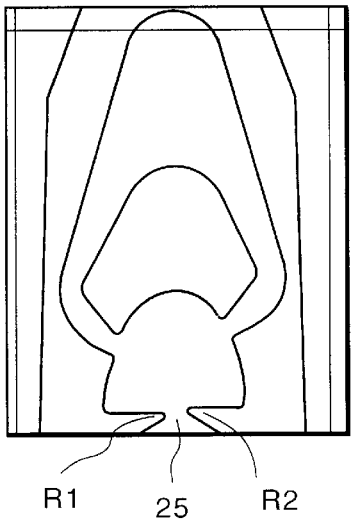
FIGS. 4A–4D are illustrations of the oscillator disclosed in the above-identified Raghu application with various features changed to achieve the yaw of a liquid fan spray to achieve certain degrees of yawing.

In the embodiment shown in FIG. 4A, the exit throat 25 is shifted to one side (cross flow) and the radii R1, R2 shifted relative to each other (along the flow line) (right yaw).

Figure 4B:
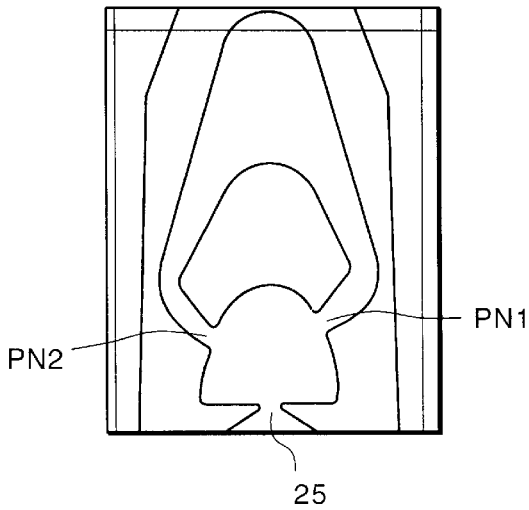

In FIG. 4B, the exit 25 and the power nozzle orifices PN1 and PN2 are both offset along the flow line.

Figure 4C:
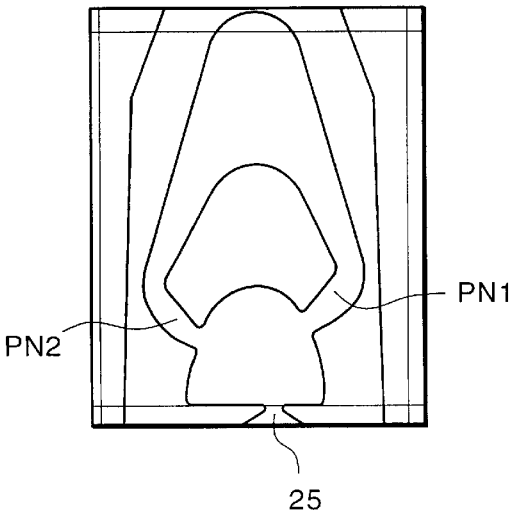
Figure 4D:
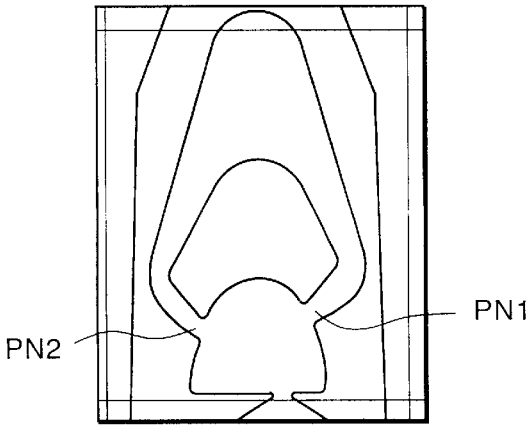

In FIG. 4C, the exit throat 25 is shifted off-center (cross flow), and the power nozzles PN1, PN2 are shifted along the flow. Finally, in FIG. 4D, the exit throat is shifted off-center (cross flow), the throat is shifted along the flow and the power nozzles PN2 and PN2 are shifted along the flow.

Thus, the yaw of the spray can be enhanced by combining two or more approaches.

While the invention has been described in relation to preferred embodiments of the invention, it will be appreciated that other embodiments, adaptations and modifications of the invention will be apparent to those skilled in the art.

What is claimed is:

1. A method of adjusting the output fan spray angular orientation of a fluidic oscillator having an oscillation chamber with an oscillation chamber centerline and an exit throat for issuing a fan spray to ambient without physical rotation of the fluidic oscillator comprising:

said exit throat having a centerline, shifting said exit throat centerline such that said exit throat centerline is not coaxial with said oscillation chamber centerline.

2. The method defined in claim 1 wherein said fluidic oscillator has at least a pair of power nozzles issuing jets of liquid into said oscillation chamber and each power nozzle has an axis, the further improvement wherein said axes of said power nozzles do not intersect on said oscillation chamber centerline.

3. In a fluidic oscillator for issuing a liquid spray to ambient, the fluidic oscillator having an oscillation chamber with an upstream end and a downstream end, at least one power nozzle for issuing a jet of fluid into said oscillation chamber, and an exit throat at the downstream end for issuing an oscillating jet of liquid to ambient, said oscillation chamber having a centerline, the improvement comprising:

means to cause said fluidic oscillator to issue a sweeping jet of fluid which is yawed to a selected side of said centerline.

4. The fluidic oscillator defined in claim 3 wherein said at least one power nozzle is aligned with said centerline and issues a liquid jet into said oscillation chamber along said centerline.

5. The fluidic oscillator defined in claim 4 wherein said means includes an exit throat which has a centerline which is not co-linear with the centerline of said oscillation chamber.

6. The fluidic oscillator defined in claim 3 wherein there are at least a pair of said power nozzles, each power nozzle having an axis with an orientation angle which intersects at the common point on said centerline.

7. The fluidic oscillator defined in claim 3 wherein there is at least a pair of said power nozzles, said means includes each power nozzle having an axis with respective orientation angles which do not intersect at said centerline.

8. The fluidic oscillator defined in claim 7 wherein said at least one outlet has an outlet throat region and said throat region is offset relative to said centerline.

9. The fluidic oscillator defined in claim 3 wherein said means includes offsetting said outlet relative to said centerline.

10. A fluidic oscillator for issuing a jet of liquid spray to ambient, said fluidic oscillator having an oscillation chamber with an upstream end and a downstream end and at least one power nozzle for issuing a jet of liquid into said oscillation chamber at said upstream end and an exit throat at said downstream end for issuing a sweeping jet of liquid to ambient to form a spray having a given centerline which is yawed relative to the centerline of said oscillation chamber.

* * * * *